US011633003B2

(12) United States Patent
Choi et al.

(10) Patent No.: US 11,633,003 B2
(45) Date of Patent: Apr. 25, 2023

(54) ASSEMBLY-TYPE INSOLE FOR FOOTWEAR

(71) Applicants: Si Hyun Choi, Busan (KR); Kwang Sup Moon, Busan (KR)

(72) Inventors: Si Hyun Choi, Busan (KR); Kwang Sup Moon, Busan (KR)

( * ) Notice: Subject to any disclaimer, the term of this patent is extended or adjusted under 35 U.S.C. 154(b) by 0 days.

(21) Appl. No.: 16/981,520

(22) PCT Filed: Mar. 18, 2019

(86) PCT No.: PCT/KR2019/003126
§ 371 (c)(1),
(2) Date: Sep. 16, 2020

(87) PCT Pub. No.: WO2019/182311
PCT Pub. Date: Sep. 26, 2019

(65) Prior Publication Data

US 2021/0112912 A1 Apr. 22, 2021

(30) Foreign Application Priority Data

Mar. 21, 2018 (KR) ..... 10-2018-0032476

(51) Int. Cl.
*A43B 7/142* (2022.01)
*A43B 7/144* (2022.01)
(Continued)

(52) U.S. Cl.
CPC ..... *A43B 7/142* (2013.01); *A43B 7/144* (2013.01); *A43B 17/003* (2013.01); *A43B 17/18* (2013.01)

(58) Field of Classification Search
CPC ..... A43B 7/142; A43B 7/143; A43B 7/144
See application file for complete search history.

(56) References Cited

U.S. PATENT DOCUMENTS 5,014,706 A * 5/1991 Philipp ..... A43B 7/141 36/140
RE33,648 E * 7/1991 Brown ..... A43B 13/12 36/44

(Continued)

FOREIGN PATENT DOCUMENTS

KR 10-2005-0088885 A 9/2005
KR 20-0421262 Y1 7/2006

(Continued)

*Primary Examiner* — Megan E Lynch
(74) *Attorney, Agent, or Firm* — Rabin & Berdo, P.C.

(57) ABSTRACT

An assembly-type insole of the present invention is a shoe insole arranged on an inner bottom surface of a shoe so as to protect the sole of a wearer's foot, the insole comprising: a heel bottom-support configured to support a bottom part of the heel of the wearer's foot; a heel bottom support plate configured to allow the heel bottom support to be attached thereto; an inner arch support configured to support the inner arch part of the wearer's foot sole; an arch inside-support plate positioned inwardly from the longitudinal center of the arch of the foot sole to allow the inner arch support attached thereto; an outer arch support configured to support the outer arch part of the foot sole; an outer arch support plate positioned outwardly from the longitudinal center of the arch of the foot sole to allow the outer arch support attached thereto; an insole base configured to support the arch of the sole and the sole positioned at the front of the arch; and a support plate engagement member configured to allow the heel bottom support plate, the inner arch support plate, and the outer arch support plate to be engaged thereto.

6 Claims, 7 Drawing Sheets

(51) Int. Cl.
*A43B 17/00* (2006.01)
*A43B 17/18* (2006.01)

(56) References Cited

U.S. PATENT DOCUMENTS 5,184,409 A * 2/1993 Brown ..... A43B 7/142 36/173
6,453,578 B1 * 9/2002 Yung ..... A43B 7/142 36/166
6,510,626 B1 * 1/2003 Greenawalt ..... A43B 7/142 36/160
2004/0118017 A1 * 6/2004 Dalton ..... A43B 7/142 36/44
2004/0181971 A1 * 9/2004 Turkbas ..... A43B 7/142 36/44
2004/0194344 A1 * 10/2004 Tadin ..... A43B 17/02 36/44
2006/0059726 A1 * 3/2006 Song ..... A43B 7/1435 36/142
2007/0033834 A1 * 2/2007 Cheskin ..... A43B 7/143 36/44
2007/0079532 A1 * 4/2007 Ramirez ..... A43B 17/00 36/140
2007/0294922 A1 * 12/2007 Ma ..... A43B 17/02 36/142
2009/0049712 A1 * 2/2009 Steszyn ..... A43B 7/1425 36/91
2012/0226210 A1 * 9/2012 Normandin ..... A43B 7/142 602/23
2013/0192088 A1 * 8/2013 Veldman ..... A43B 7/144 36/44
2013/0318818 A1 12/2013 Gardiner
2015/0026998 A1 * 1/2015 Lin ..... A43B 7/144 36/44
2015/0089840 A1 * 4/2015 Hsiang ..... A43B 13/203 36/102
2015/0201702 A1 * 7/2015 Paul ..... A43B 17/14 36/44
2015/0237959 A1 * 8/2015 Wynn ..... A43B 7/145 36/44
2017/0027277 A1 * 2/2017 Anthony ..... A43B 17/02
2018/0110291 A1 * 4/2018 Granger ..... A43B 7/144
2018/0116338 A1 * 5/2018 Glaze ..... A43B 13/36
2018/0140040 A1 * 5/2018 Granger ..... A43B 7/144
2018/0192739 A1 * 7/2018 Granger ..... A43B 7/1435
2019/0125032 A1 * 5/2019 Liu ..... A43B 7/1465

FOREIGN PATENT DOCUMENTS

KR 10-2011-0127087 A 11/2011
KR 10-2018-0004178 A 1/2018
WO 2012/106803 A1 8/2012

* cited by examiner

ASSEMBLY-TYPE INSOLE FOR FOOTWEAR

CROSS-REFERENCE TO RELATED APPLICATIONS

This application claims the benefit of Korean Patent Application No. 10-2018-0032476, filed on Mar. 21, 2018 in the Korean Intellectual Property Office, which is incorporated herein by reference in its entirety.

BACKGROUND OF THE INVENTION

1. Field of the Invention

The present invention relates to an assembly-type insole for footwear, which can be configured to implement, in an assembled fashion, corresponding elements of respectively supporting the anterior side, the arch and the heel of the sole of a wearer's foot so as to be supported in conformity to the contour of the foot sole.

2. Description of Related Art

In general, an insole for footwear refers to a sort of protective pad that is disposed on an inner bottom surface of a shoe so as to relieve a repulsive force from the ground to protect a wearer's foot sole.

A conventional insole for footwear has typically been manufactured in several shapes to conform to a general foot shape.

The shape of the wearer's foot is varied, but he or she is required to select and use an insole that fits his or her foot shape from among insoles made in several shapes.

A conventional insole manufacturing technology is not enough to manufacture all kinds of insoles conforming to the shapes of various wearers' feet. Thus, the development of a deformable material for supporting the wearers' feet while abutting against the foot arch and the like has been in progress in order to manufacture an insole for footwear that is adapted to fit the shapes of many wearers' feet.

However, there is a limitation in the development of a material suitable for an insole for footwear that conforms to all wearers' foot shapes, thus causing them to suffer from an inconvenience of use during walking or driving.

In the recent years, such an insole for footwear has been variously developed as a custom insole for footwear, which is manufactured for a special wearer such as a patient, an athlete or the like.

This custom insole for footwear is manufactured in the form of an appropriate special custom insole having an optimum repulsive force against a pressure applied to respective plantar sites, for example, mainly in the case of an athlete who requires much physical motion, such as a marathon runner or the like.

Such a conventional custom insole for footwear, however, entails a problem in that it is generally made in an integral form to conform to the entire shape of the wearer's foot sole by using the same material, and the manufacture cost is high, which inevitably causes a burden on a general public.

SUMMARY OF THE INVENTION

Accordingly, the present invention has been made to solve the aforementioned problems occurring in the prior art, and it is an object of the present invention to provide an assembly-type insole for footwear, which is configured to be supported in conformity to the contour of a wearer's foot sole, and which is configured to implement, in an assembled fashion, corresponding elements of respectively supporting the anterior side, the arch and the heel of the wearer's foot sole so that the respective corresponding elements can be assembled and used to suit the wearer's taste.

To achieve the above object, the present invention provides an assembly-type insole for footwear, which is disposed on an inner bottom surface of a shoe so as to protect the sole of a wearer's foot, the assembly-type insole including: a heel bottom support configured to support a bottom part of the heel of the wearer's foot; a heel bottom support plate positioned beneath the heel bottom support to allow the heel bottom support to be attached thereto; an inner arch support positioned at a front side of the heel bottom support and configured to support the inner arch part of the wearer's foot sole; an inner arch support plate positioned inwardly from the longitudinal center of the arch of the foot sole in such a manner as to be positioned beneath the inner arch support to allow the inner arch support to be attached thereto; an outer arch support positioned at a front side of the heel bottom support and configured to support the outer arch part of the foot sole; an outer arch support plate positioned outwardly from the longitudinal center of the arch of the foot sole in such a manner as to be positioned beneath the outer arch support while abutting against the inner arch support plate to allow the outer arch support to be attached thereto; an insole base configured to support both the arch of the foot sole and a foot sole part positioned at a front side of the arch; a support plate engagement member positioned beneath the heel bottom support plate, the inner arch support plate and the outer arch support plate to allow the heel bottom support plate, the inner arch support plate and the outer arch support plate to engagedly assembled thereto in a replaceable manner.

In the assembly-type insole for footwear of the present invention, the insole base may abut against the heel bottom support, the inner arch support and the outer arch support.

In the assembly-type insole for footwear of the present invention, portions where the heel bottom support, the inner arch support and the outer arch support abuts against the insole base may have a press-fit engagement structure.

In the assembly-type insole for footwear of the present invention, the support plate engagement member may include one or more projections formed on a top surface thereof, and the heel bottom support plate, the inner arch support plate 40 and the outer arch support plate may include one or more projection engagement through-holes respectively formed therein to correspond to the projections so that the projections can be press-fittingly engaged to and disengaged from the projection engagement through-holes.

The assembly-type insole for footwear of the present invention may further include an insole cover fabric coveringly attached to the top surfaces of the insole base, the heel bottom support, the inner arch support and the outer arch support simultaneously.

In the assembly-type insole for footwear of the present invention, the underside of the insole cover fabric may be coated with a pressure-sensitive adhesive so that the insole cover fabric can be attached to and detached from the insole base, the heel bottom support, the inner arch support and the outer arch support.

In the assembly-type insole for footwear of the present invention, the insole base, the heel bottom support, the inner arch support and the outer arch support may include a Velcro formed on the top surfaces thereof, respectively, and the insole cover fabric may include a Velcro attachment member formed on the underside thereof so as to be attached to Velcro loops to enable attachment/detachment of the insole cover fabric to/from the insole base, the heel bottom support, the inner arch support and the outer arch support.

In the assembly-type insole for footwear of the present invention, the heel bottom support, the inner arch support, the outer arch support and the insole base have different hardnesses from one another.

Effects of the Invention

The assembly-type insole for footwear according to the present invention has an advantage in that it is configured to be supported in conformity to the contour of a wearer's foot sole, and is configured to implement, in an assembled fashion, corresponding elements of respectively supporting the anterior side, the arch and the heel of the wearer's foot sole so that the respective corresponding elements can be assembled and used to suit the wearer's taste, and thus footwear insoles of various shapes can be provided.

In addition, the assembly-type insole for footwear according to the present invention has another advantage in that it is inexpensive compared to the conventional custom insole for footwear made in an integral form, and the respective separate elements can be assembled and used to suit a wearer's taste and the use purpose of the respective elements, and thus it is convenient to carry and use. Further, the assembly-type insole for footwear of the present invention has still another advantage in that the hardness of the respective elements is made different so that an individual wearing feeling can be increased.

BRIEF DESCRIPTION OF THE DRAWINGS

The above and other objects, features and advantages of the present invention will be apparent from the following detailed description of the preferred embodiments of the invention when taken in conjunction with the accompanying drawings, in which.

DETAILED DESCRIPTION OF THE PREFERRED EMBODIMENTS

Hereinafter, an assembly-type insole for footwear according to the present invention will be described in detail with reference to the accompanying drawings.

Figure 1:
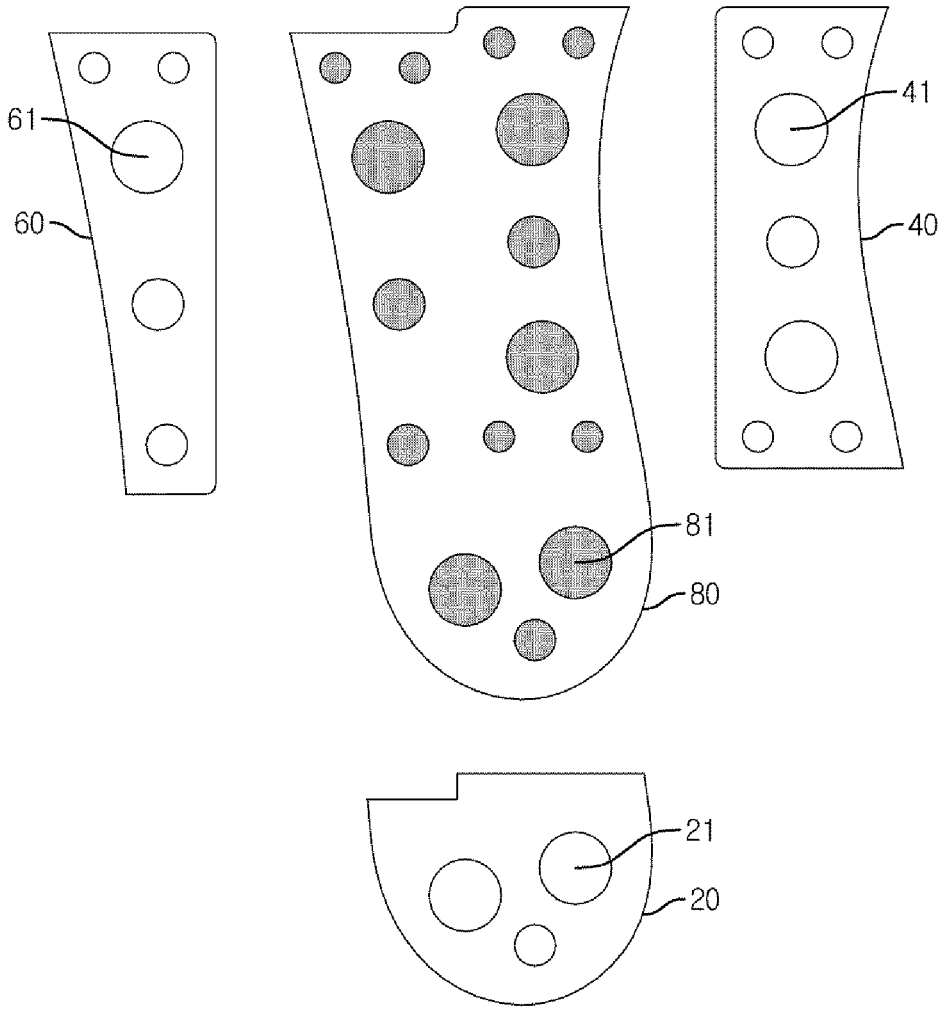
FIG. 1 is an exploded top plan view showing an assembly-type insole for footwear according to the present invention.
Figure 2:
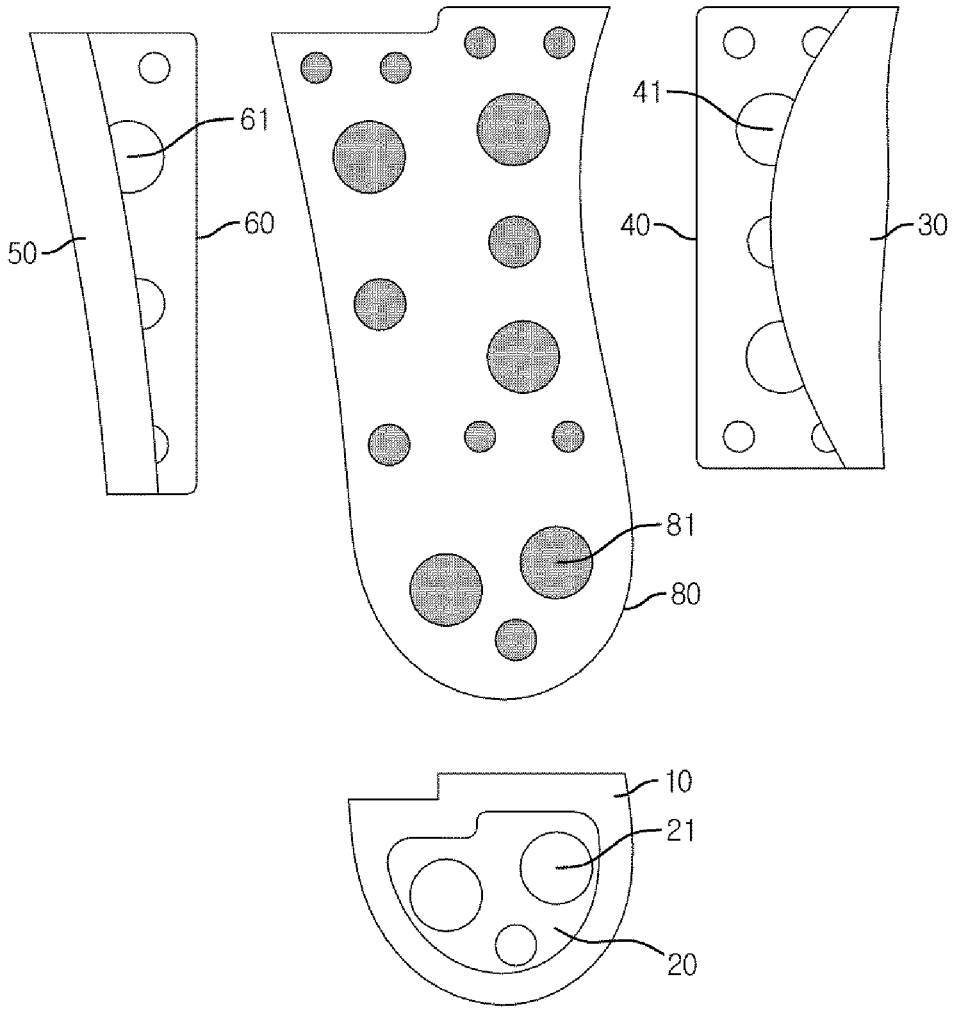
FIG. 2 is an exploded top plan view showing a structure for allowing respective corresponding support elements to be engaged with respective support plates in an assembly-type insole for footwear according to the present invention.
Figure 3:
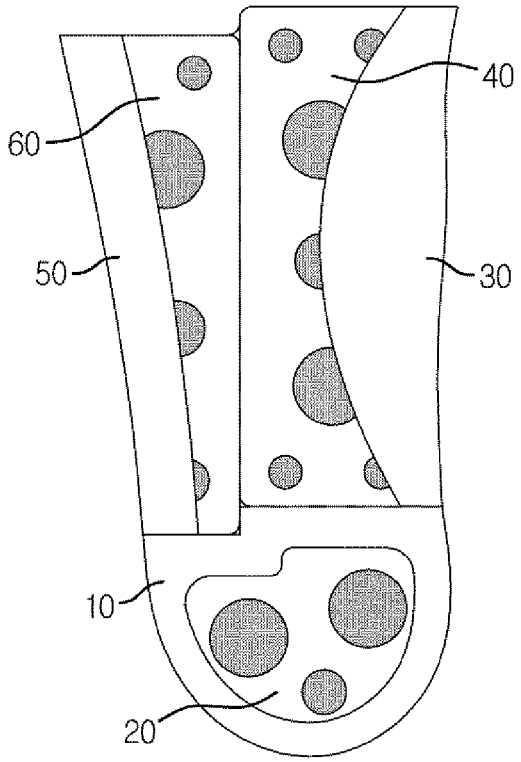
FIG. 3 is an assembled top plan view showing a state in which respective corresponding support elements have been engaged with respective support plates in an assembly-type insole for footwear according to the present invention.
Figure 4:
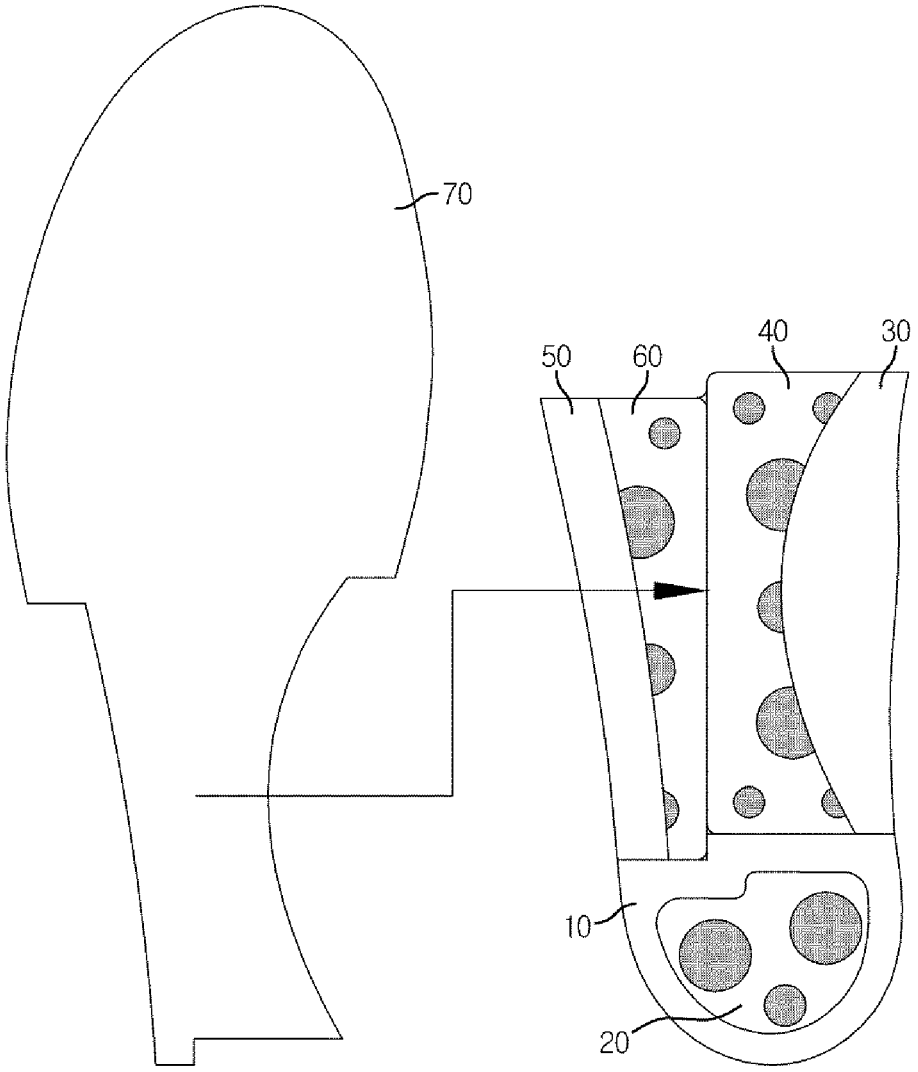
FIG. 4 is an exploded top plan view showing a structure for engagement of an insole base with the assembly of FIG. 3.
Figure 5:
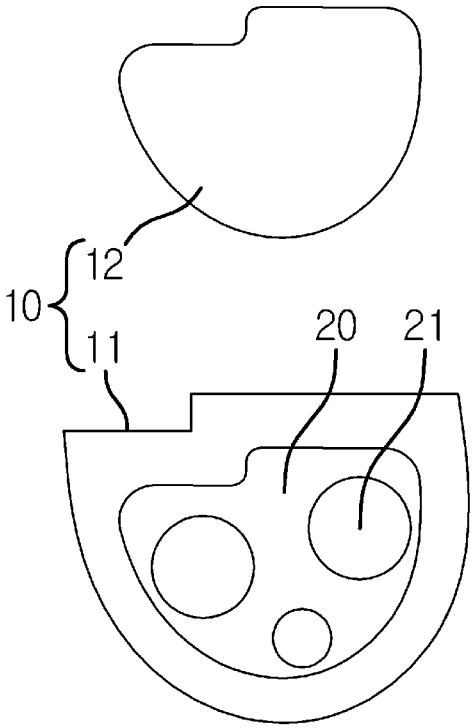
FIG. 5 is a top plan view showing a heel bottom support plate and a heel bottom support in an assembly-type insole for footwear according to the present invention.
Figure 6:
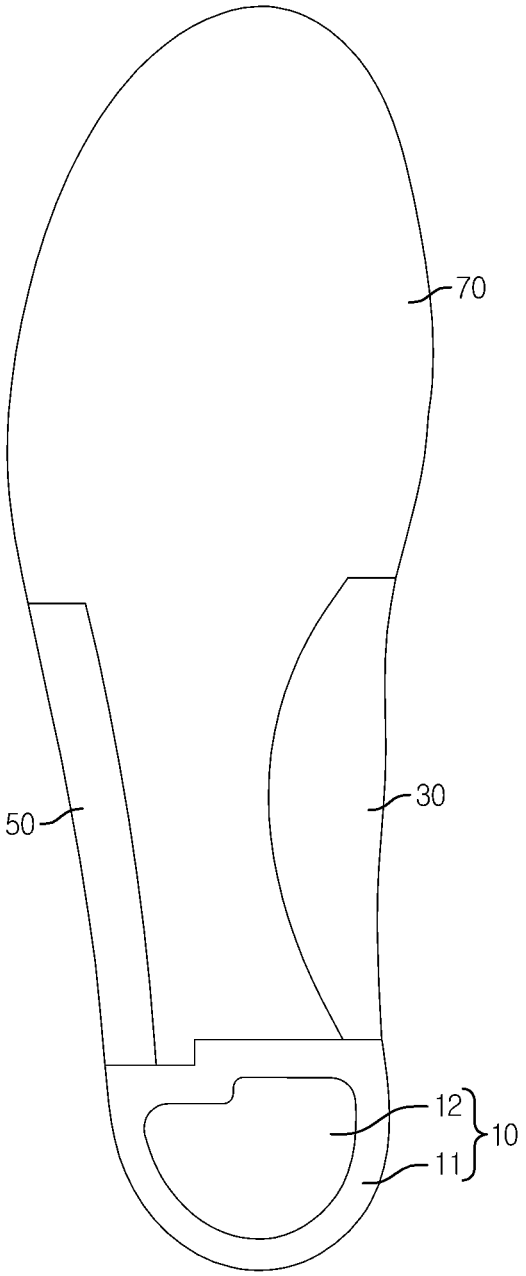
FIG. 6 is a top plan view showing an assembled state of an assembly-type insole for footwear according to the present invention.
Figure 7:
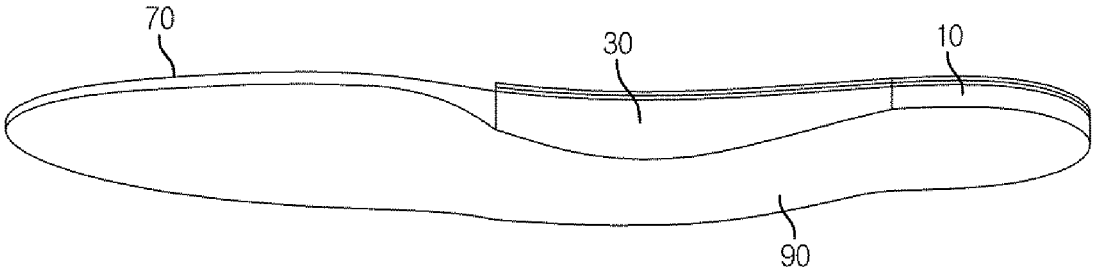
FIG. 7 is a perspective view showing a state in which an insole cover fabric is attached to a top of an assembly-type insole for footwear according to the present invention.
Figure 8:
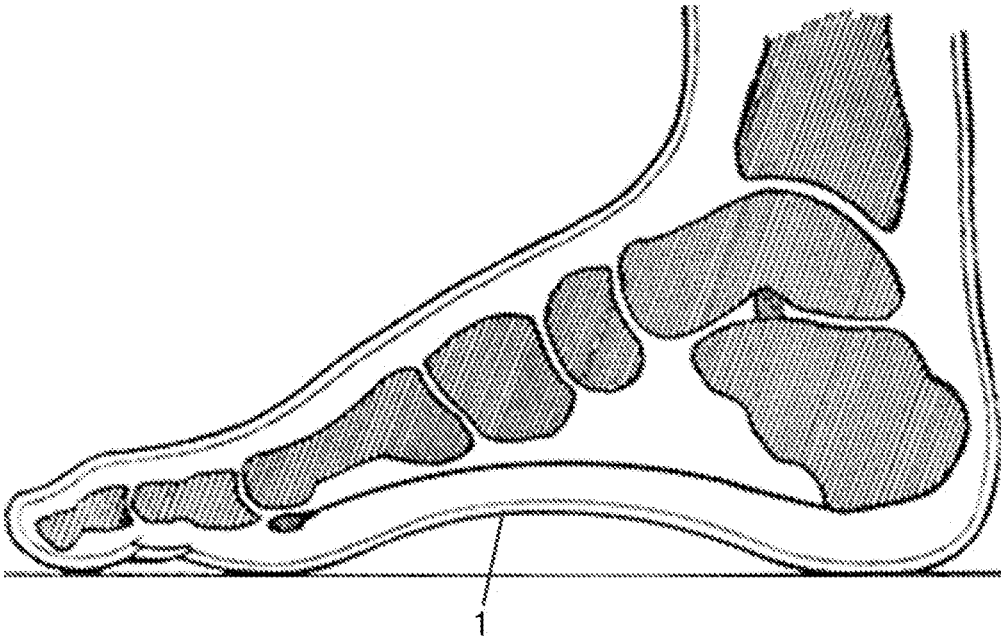
FIG. 8 is a side view showing a foot bone for defining a foot arch.

FIG. 1 is an exploded top plan view showing an assembly-type insole for footwear according to the present invention, FIG. 2 is an exploded top plan view showing a structure for allowing respective corresponding support elements to be engaged with respective support plates in an assembly-type insole for footwear according to the present invention, FIG. 3 is an assembled top plan view showing a state in which respective corresponding support elements have been engaged with respective support plates in an assembly-type insole for footwear according to the present invention, FIG. 4 is an exploded top plan view showing a structure for engagement of an insole base with the assembly of FIG. 3, FIG. 5 is a top plan view showing a heel bottom support plate and a heel bottom support in an assembly-type insole for footwear according to the present invention, FIG. 6 is a top plan view showing an assembled state of an assembly-type insole for footwear according to the present invention, FIG. 7 is a perspective view showing a state in which an insole cover fabric is attached to a top of an assembly-type insole for footwear according to the present invention, and FIG. 8 is a side view showing a foot bone for defining a foot arch.

The assembly-type insole for footwear according to the present invention is disposed on an inner bottom surface of a shoe and serves to protect the sole of a wearer's foot.

The assembly-type insole for footwear according to the present invention includes a heel bottom support 10, a heel bottom support plate 20, an inner arch support 30, an inner arch support plate 40, an outer arch support 50, an outer arch support plate 60; an insole base 70, and a support plate engagement member 80.

The heel bottom support 10 serves to support a bottom part of the heel of the wearer's foot. The heel bottom support 10 may be formed in an integral form, and as shown in the drawing, may consist of a peripheral support portion 11 configured to support the periphery of the bottom part of the heel of the wearer's foot, and a central support portion 12 insertedly engaged to the peripheral support portion 11 so as to support the central part of the heel of the wearer's foot (see FIG. 5).

The central support portion 12 may be formed of a material different in hardness and elasticity from the peripheral support portion 11 depending on the wearer's taste.

The heel bottom support plate 20 is positioned beneath the heel bottom support 10 to allow the heel bottom support 10 to be attached thereto as shown in FIG. 5.

The inner arch support 30 is positioned at a front side of the heel bottom support 10 and serves to support the inner part of the arch 1 (see FIG. 8) of the wearer's foot sole.

The inner arch support plate 40 is positioned inwardly from the longitudinal center of the arch of the foot sole in such a manner as to be positioned beneath the inner arch support 30 to allow the inner arch support 30 to be attached thereto as shown in FIG. 2.

The outer arch support 50 is positioned at a front side of the heel bottom support 10 and serves to support the outer part of the arch of the foot sole.

The outer arch support plate 60 is positioned outwardly from the longitudinal center of the arch of the foot sole in such a manner as to be positioned beneath the outer arch support 50 while abutting against the inner arch support plate 40 to allow the outer arch support 50 to be attached thereto as shown in FIG. 2.

The inner arch support 30 and the outer arch support 50 support the inner and outer parts of the arch of the foot sole so that the arch part of the foot sole can be stably supported.

The insole base 70 serves to support both the arch of the foot sole and the foot sole part positioned at a front side of the arch.

The support plate engagement member 80 is positioned beneath the heel bottom support plate 20, the inner arch support plate 40 and the outer arch support plate 60 to allow the heel bottom support plate 20, the inner arch support plate 40 and the outer arch support plate 60 to engagedly assembled thereto in a replaceable manner.

As such, the assembly-type insole for footwear of the present invention has an advantage in that the respective corresponding elements of supporting the foot sole are implemented in an assembled fashion so that the respective corresponding elements can be selectively assembled and used to suit the shape, the required hardness and the use purpose of the respective corresponding elements as well as a wearer's taste.

In this case, the insole base 70 preferably abuts against the heel bottom support 10, the inner arch support 30 and the outer arch support 50 (see FIG. 6). When the insole base 70 is disposed so as to abut against the heel bottom support 10, the inner arch support 30 and the outer arch support 50, the insole base 70, the heel bottom support 10, the inner arch support 30 and the outer arch support 50 constitute the entire insole together so that the wearer's foot sole can be supported stably. Moreover, the heel bottom support 10, the inner arch support 30, the outer arch support 50 and the insole base 70 can be replaceable with new ones.

In this case, the heel bottom support 10, the inner arch support 30 and the outer arch support 50 are directly attached to the heel bottom support plate 20, the inner arch support plate 40 and the outer arch support plate 60, respectively, by a wearer, or are attached to the heel bottom support plate 20, the inner arch support plate 40 and the outer arch support plate 60. Thus, the heel bottom support 10, the inner arch support 30 and the outer arch support 50 may be configured such that they are replaced together with the heel bottom support plate 20, the inner arch support plate 40 and the outer arch support plate 60.

In addition, portions where the heel bottom support 10, the inner arch support 30 and the outer arch support 50 abuts against the insole base 70 may include a projection and a recess so that the heel bottom support 10, the inner arch support 30 and the outer arch support 50 are engaged with the insole base 70 in a press-fit engagement manner. As such, in the case where the portions where the heel bottom support 10, the inner arch support 30 and the outer arch support 50 abuts against the insole base 70 are engaged with each other in a press-fit engagement manner, when the entire insole is assembled, the engaging strength can be increased.

Further, preferably, the support plate engagement member 80 includes a plurality of projections 81 formed on a top surface thereof, and the heel bottom support plate 20, the inner arch support plate 40 and the outer arch support plate 60 include a plurality of projection engagement through-holes 21, 41 and 61 respectively formed therein to correspond to the projections 81 so that the projections 81 can be press-fittingly engaged to and disengaged from the projection engagement through-holes 21, 41 and 61 as shown in FIGS. 1 and 2. As such, when the support plate engagement member 80 including the projections 81 are press-fittingly engaged with the heel bottom support plate 20, the inner arch support plate and the outer arch support plate 60 including the projection engagement holes 21, 41 and 61, the heel bottom support plate 20, the inner arch support plate 40 and the outer arch support plate 60 can be easily and stably engaged to the top portion of the support plate engagement member 80 and the engaging strength can be increased.

Besides, the assembly-type insole for footwear of the present invention preferably further includes an insole cover fabric 90 coveringly attached to the top surfaces of the insole base 70, the heel bottom support 10, the inner arch support 30 and the outer arch support 50 simultaneously (see FIG. 7).

When the insole cover fabric 90 is attached to the top surfaces of the insole base 70, the heel bottom support 10, the inner arch support 30 and the outer arch support 50 simultaneously, the engaging strength of the insole base 70, the heel bottom support 10, the inner arch support 30 and the outer arch support 50 that constitute the entire insole after completion of assembly can be improved as well as the insole base 70, and the heel bottom support 10, the inner arch support 30 and the outer arch support 50 that abut against one another can be prevented from being widened laterally so that the foot sole can be stably supported.

In this case, the underside of the insole cover fabric 90 is preferably coated with a pressure-sensitive adhesive so that the insole cover fabric 90 can be easily attached to and detached from the insole base 70, the heel bottom support 10, the inner arch support 30 and the outer arch support 50. When the pressure-sensitive adhesive is coated on the underside of the insole cover fabric 90 so that the insole cover fabric 90 can be attached to and detached from the insole base 70, the heel bottom support 10, the inner arch support 30 and the outer arch support 50, the removal of the insole cover fabric 90 from the insole base 70, the heel bottom support 10, the inner arch support 30 and the outer arch support 50 upon assembly of the elements of the insole depending on a wearer's taste and the re-attachment of the insole cover fabric 90 to the insole base 70, the heel bottom support 10, the inner arch support 30 and the outer arch support 50 after completion of assembly of the elements of the insole can be facilitated.

In addition, a Velcro may be used for the attachment of the insole cover fabric to the insole base 70, the heel bottom support 10, the inner arch support 30 and the outer arch support 50. In this case, the insole base 70, the heel bottom support 10, the inner arch support 30 and the outer arch support 50 include a Velcro (not shown) attached to the top surfaces thereof, respectively, and the insole cover fabric 90 includes a Velcro attachment member (not shown) attached to the underside thereof so as to enable attachment/detachment of the insole cover fabric 90 to/from the insole base 70, the heel bottom support 10, the inner arch support 30 and the outer arch support 50.

Further, preferably, the heel bottom support 10, the inner arch support 30, the outer arch support 50 and the insole base 70 have different hardnesses from one another.

As such, when the heel bottom support 10, the inner arch support 30, the outer arch support 50 and the insole base 70 are set to have different hardnesses, an individual wearing feeling according to a personal taste can be increased.

While the present invention has been described in connection with the exemplary embodiments illustrated in the drawings, they are merely illustrative and the invention is not limited to these embodiments but can be embodied in different various forms. It will be appreciated by a person having an ordinary skill in the art that various equivalent modifications and variations of the embodiments can be made without departing from the spirit and scope of the present invention. Therefore, the true technical scope of the present invention should be defined by the technical sprit of the appended claims.

What is claimed is:

1. An assembly-type insole for footwear, which is disposed on an inner bottom surface of a shoe so as to protect the sole of a wearer's foot, the assembly-type insole comprising: a heel bottom support configured to support a bottom part of the heel of the wearer's foot; a heel bottom support plate positioned beneath the heel bottom support to allow the heel bottom support to be attached thereto; an inner arch support positioned at a front side of the heel bottom support and configured to support the inner arch part of the wearer's foot sole; an inner arch support plate positioned inwardly from the longitudinal center of the arch of the foot sole in such a manner as to be positioned beneath the inner arch support to allow the inner arch support to be attached thereto; an outer arch support positioned at a front side of the heel bottom support and configured to support the outer arch part of the foot sole; an outer arch support plate positioned outwardly from the longitudinal center of the arch of the foot sole in such a manner as to be positioned beneath the outer arch support while abutting against the inner arch support plate to allow the outer arch support to be attached thereto; an insole base having a front portion configured to support both a foot sole part positioned at a front side of the arch wherein the insole base includes a rear part fitted between the inner arch support and the outer arch support, the rear part is configured to support a middle arch portion of the foot sole; and a support plate engagement member positioned beneath the heel bottom support plate the inner arch support plate and the outer arch support plate to allow the heel bottom support plate, the inner arch support plate and the outer arch support plate to be engagedly assembled thereto in a replaceable manner, wherein the rear part of the insole base abuts against a front edge of the heel bottom support, an inner edge of the inner arch support, and an inner edge of the outer arch support; and where the heel bottom support, the inner arch support, and the outer arch support abut against the insole base have a press-fit engagement structure.

2. The assembly-type insole for footwear according to claim 1, wherein the support plate engagement member comprises one or more projections formed on a top surface thereof, and the heel bottom support plate, the inner arch support plate and the outer arch support plate comprises one or more projection engagement through-holes respectively formed therein to correspond to the projections so that the projections can be press-fittingly engaged to and disengaged from the projection engagement through-holes.

3. The assembly-type insole for footwear according to claim 1, further comprising an insole cover fabric attached to cover the top surfaces of the insole base, the heel bottom support, the inner arch support and the outer arch support simultaneously.

4. The assembly-type insole for footwear according to claim 3, wherein the underside of the insole cover fabric is coated with a pressure-sensitive adhesive so that the insole cover fabric can be attached to and detached from the insole base, the heel bottom support, the inner arch support and the outer arch support.

5. The assembly-type insole for footwear according to claim 3, wherein the insole base, the heel bottom support, the inner arch support and the outer arch support comprises a hook formed on the top surfaces thereof, respectively, and the insole cover fabric comprises a loop fastener formed on the underside thereof so as to be attached to the hook to enable attachment/detachment of the insole cover fabric to/from the insole base, the heel bottom support, the inner arch support and the outer arch support.

6. The assembly-type insole for footwear according to claim 1, wherein the heel bottom support, the inner arch support, the outer arch support and the insole base have different hardnesses from one another.

* * * * *